United States Patent [19]

Takeda et al.

[11] Patent Number: 4,704,748

[45] Date of Patent: Nov. 10, 1987

[54] WASHING DEVICE FOR PARTS OF HUMAN BODY

[75] Inventors: Hisanobu Takeda, Aichi; Yasuhiro Aso, Toyota, both of Japan

[73] Assignee: Aisin Seiki Kabushiki Kaisha, Aichi, Japan

[21] Appl. No.: 836,660

[22] Filed: Mar. 5, 1986

[30] Foreign Application Priority Data

Mar. 29, 1985 [JP] Japan ..... 60-68011
Sep. 27, 1985 [JP] Japan ..... 60-215590

[51] Int. Cl.[4] ..... A61H 35/00
[52] U.S. Cl. ..... 4/420.4; 4/448
[58] Field of Search ..... 4/443–448, 4/420.1, 420.5

[56] References Cited

U.S. PATENT DOCUMENTS 4,208,746 6/1980 Minamoto et al. ..... 4/420.2 X
4,551,868 11/1985 Kawai et al. ..... 4/443
4,564,961 1/1986 Kaneko et al. ..... 4/420.5 X
4,570,274 2/1986 Kaneko et al. ..... 4/443
4,581,779 4/1986 Matsui et al. ..... 4/420.4 X

FOREIGN PATENT DOCUMENTS 59-102031 6/1984 Japan .

*Primary Examiner*—Charles E. Phillips

*Attorney, Agent, or Firm*—Sughrue, Mion, Zinn, Macpeak & Seas

[57] ABSTRACT

In a washing device for parts of human body including a first hollow piston with a nozzle at the front end thereof and a second hollow piston with a nozzle at the front end thereof; a drive means for said first and second pistons comprises a single drive motor, a rotatable member to be driven by said motor and a belt-like member one end of which is anchored to the first piston and the other end of which is anchored to the second piston; said belt-like member has a middle portion engaging the periphery of the rotatable member and a pressurized water supply means. As one aspect of the invention, the rotatable member rotates reversibly at a fixed position and transmits the driving force to the belt-like member so as to move selectively the first and second pistons and a retracted inoperative position. In this case, these first and second piston move in opposite directions each other. While as another aspect of the invention, said rotatable member not only rotates reversibly, but also slidable while rotating, being assisted by a guide shoe and a resilient member normally urging the rotatable member in the extreme position. The washing device of this invention can selectively move the nozzle carrying pistons between operative and inoperative positions very quickly by a simplified drive mechanism.

11 Claims, 9 Drawing Figures

123
145
146
147
101
120
102
105
140
143
124
125
144
109
142
110
148
104
111
106
113
112
115
114
a
134
b
132
131
129
122
128
121
118
119
130
II
107
116
117
127
126
108
339
337
100
103
237
238
236
235
234

WASHING DEVICE FOR PARTS OF HUMAN BODY

BACKGROUND OF THE INVENTION

1. Field of the Invention

This invention relates to an improvement of a washing device for parts of human body, which is to be used in a flush toilet (hereinafter, it will be merely called "a washing device").

2. Description of the Prior Art

In recent years, the aforesaid washing device has been appreciated on its utility value in a sanitary point of view and a great number of washing devices have been widely used.

In the conventional washing devices, it has been known that a single piston with two types of water spouting nozzles at the front end thereof is moved in two steps for selectively bringing one of said nozzles to an operative position for the anus- or bidet-washing.

For example, reference should be made to Japanese patent application, filed on Dec. 1, 1982 and laid-open to public inspection under Publication No. 102,031/1984, which discloses the aforesaid conventional washing device.

According to this prior art, two types of nozzles are detachably carried by a single piston, being adjacent to each other. As a result, if one of the nozzles is projected into its operative position, the other one is also projected together even when the latter is not in use. Therefore, it is inevitable that the nozzle not to be in use may be exposed to splashes of the soiled water coming from the nozzle in operation. This phenomenon is extremely undesirable in a sanitary point of view. This is because these nozzles must be always kept clean.

In addition, in the aforesaid conventional washing devices, for example, if a switch for the anus-washing is unintentionally turned "ON" at the time when the bidet-washing is effected, washing conditions greatly different from those for the anus-washing are provided erroneously. In this case, there has been a fear of a person who undergoes the aforesaid washing feeling unpleasant.

In order to compensate such inconveniences, it has been heretofore proposed to provide two independent nozzle carrying pistons, one for each mode of washing, and to provide two independent motors for driving the respective nozzle carrying pistons.

This solution, however, has drawbacks that the washing device becomes quite bulky, very expensive to manufacture, as well as complex in structure.

SUMMARY OF THE INVENTION

Accordingly, an object of the present invention is to provide an improved washing device which has two types of nozzle carrying means, one for the anus-washing and the other for the bidet-washing, but has only a single motor to selectively move these nozzle carrying means between advanced and retracted positions.

A further object of the present invention is to provide an improved washing device wherein when a nozzle is not in use, the nozzle is retractable to its rest position, and thereby the nozzle not to be used is perfectly protected from any splashes of dirty soiled water.

Still a further object of the present invention is to provide an improved washing device which ensures a high degree of freedom in design, particularly on the location of nozzles, and compactness of overall configuration of the device.

Another important object of the present invention is to provide an improved washing device wherein both of the two nozzle carrying means are in their retracted rest positions when the washing devices not used.

An additional object of the present invention is to provide an improved washing device which is inexpensive to manufacture and reliable in operation.

A further additional object of the present invention is to provide an improved washing device wherein the two nozzle carrying means selectively move between an advanced and retracted positions more quickly.

An even further object of the present invention is to provide an improved washing device which has no disadvantages or drawbacks in the prior art.

DETAILED DESCRIPTION OF THE INVENTION

Figure 2:
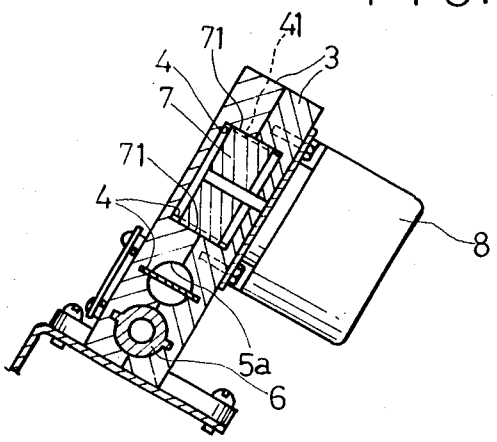
FIG. 2 is a sectional view taken substantially along the line I—I of FIG. 1.

The present invention includes two different nozzle carrying means, one for the purpose of the anus-washing and the other for the purpose of the bidet-washing, which are movable between an advanced operative position and a retracted inoperative position by means of a single motor.

These nozzle carrying means are adapted to be operative in the optimum conditions where a supply amount of water, water spouting pressure and water spouting angle are determined suitably for the respective washing purposes, anus-washing and bidet-washing.

The selective movement of the nozzle carrying means between advanced and retracted positions can be effected by a drive assembly comprising a rotatable drive member, a drive motor to rotate said rotatable drive member, a belt-like member one end of which is anchored to one of the nozzle carrying means and the other end of which is anchored to the other of the nozzle carrying means. Said belt-like member operatively engages, at its middle portion, with the periphery of said rotatable drive member to transmit the driving force directly to the respective nozzle carrying means.

At this point, it is to be noted that said rotatable drive member may be designed in two ways. In the first case, said rotatable drive member may be mounted on a shaft which is rotatable but fixed without permitting any lateral displacement. In the second case, said rotatable drive member may be mounted on a shaft which is rotatable and yet displaceable laterally. According to this second case, the drive assembly further comprises a guide shoe which is slidably mounted to effect the lateral movement of said rotatable drive member and which also serves to press the belt-like member against the periphery of said rotatable drive member to prevent the belt-like member from coming off, and a resilient member normally urging said rotatable drive member, said guide shoe and the middle portion of said belt-like member in the direction where the distance of movement of said belt-like member becomes longer.

One aspect of the present invention is directed to a washing device which comprises:

a housing to be mounted on a toilet bowl;

a supporting means disposed in said housing;

a first nozzle carrying means movably supported by said supporting means;

a second nozzle carrying means movably supported by said supporting means;

a drive means for selectively moving one of said first and second nozzle carrying means to or from an operative position where said nozzle carrying means extends into said toilet bowl, said drive means including at least one drive motor; and a pressurized water supply means for supplying pressurized water to either one of said first and second nozzle carrying means only after one of said means is exactly located in the operative position.

Said first nozzle carrying means comprises a first cylinder and a hollow piston disposed therein and provided with a nozzle at the front end thereof.

Said second nozzle carrying means comprises a second cylinder and a second hollow piston disposed therein and provided with a nozzle at the front and thereof.

The aforesaid drive means further comprises a rotatable drive member to be reversibly driven by said drive motor and a belt-like member the middle portion of which normally engages the periphery of said rotatable drive member.

One end of said belt-like member is anchored to the said first nozzle carrying means and the other end of said belt-like member is anchored to said second nozzle carrying means. By virture of this arrangement, when said belt-like member is driven, said first and second nozzle carrying means move in the opposite direction to each other.

The rotatable drive member, for example, may be a drum or a toothed wheel.

On the supporting means, there may be formed a winding channel or groove to guide the belt-like member.

The drive motor, for example, may be an electric motor or a step motor.

The belt-like member for example may be made of hard but pliable metal or plastic resin.

As to the location of the first and second nozzle carrying means, there is not any particular limitation because a belt-like member is employed to directly transmit drive energy to said first and second nozzle carrying means. It is noted that this drive mechanism ensures a high degree of freedom in designing the washing device.

A second aspect of the present invention is directed to the following washing device which comprises:

a housing to be mounted on a toilet bowl;

a supporting means disposed in said housing;

a first nozzle carrying means movably supported by said supporting means;

a second nozzle carrying means movably supported by said supporting means;

a drive means for selectively moving one of said first and second nozzle carrying means to or from an operative position where said nozzle carrying means extends into said toilet bowl, said drive means comprising a drive motor, a rotatable drive member to be reversibly driven by said motor, a belt-like member one end of which is fixedly secured to said first nozzle carrying means and the other end of which is fixedly secured to said second nozzle carrying means, said belt-like member having its middle portion normally engaging the periphery of said rotatable drive member, a guide shoe adapted to be slidable along the predetermined path together with said rotatable drive member and the middle portion of said belt-like member, and a resilient member normally urging said drive means to one of its extreme position where the distance of movement of said belt-like member becomes maximum, said rotatable drive member being slidable while rotating, and a pressurized water supply means for supplying pressurized water to either one of said first and second nozzle carrying means only when one of said means is in the operative position.

Said first nozzle carrying means comprises a first hollow piston with a nozzle at the front end thereof and a first cylinder wherein said first piston is disposed slidably.

Said second nozzle carrying means comprises a second hollow piston disposed in a second cylinder supported within a housing mounted on the toilet bowl, said second piston being provided with a nozzle at the front end thereof. Said first and second pistons are movable between advanced and retracted positions by said drive assembly including the belt-like member.

As compared with the construction in the afore-mentioned first aspect of the present invention, the construction in this second aspect is more advantageous in that the two nozzle carrying means are driven selectively to or from an operative position very quickly only through a smaller angle of rotation of said rotatable drive member.

Furthermore, according to the construction in this second aspect, it is possible to simultaneously move both of the two nozzle carrying means to their retracted, rest positions when the washing device is not in use, because said rotatable drive member is slidable while rotating and consequently a longer stroke of movement of said belt-like member becomes available.

DESCRIPTION OF THE PREFERRED EMBODIMENTS

Embodiment 1

Figure 1:
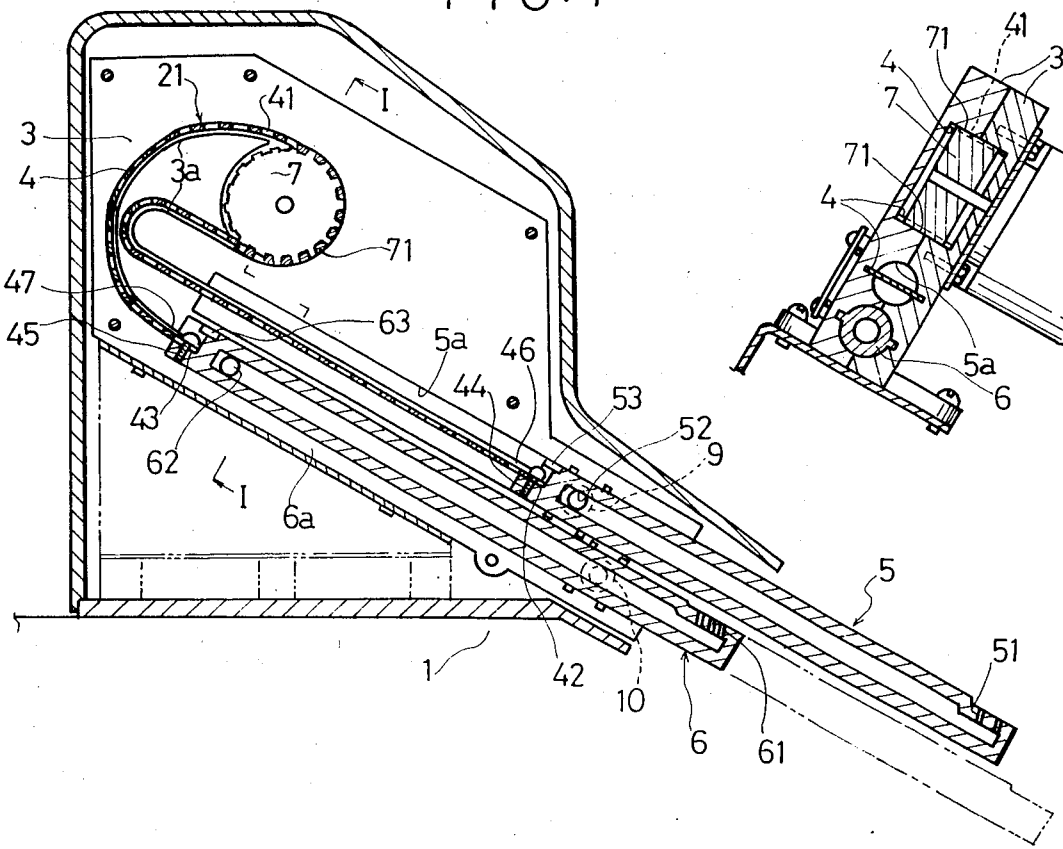
FIG. 1 is a sectional side elevation view illustrating the essential part of the washing device according to a first embodiment of the present invention.

FIG. 1 presents a sectional view illustrating the essential parts of a washing device of a first embodiment according to the present invention.

FIG. 2 is a sectional view taken along the line I—I of FIG. 1. This first embodiment corresponds to the first aspect of the invention.

The washing device of this first embodiment comprises a toilet bowl 1, a housing 2 mounted behind the toilet bowl 1, a supporting plate or means 3 disposed in said housing 2 and having a guide channel 3*a* therein, a belt-like member 4 movably put in said guide channel 3*a*, a first piston 5 having a nozzle 51 at the first end thereof, a second piston 6 having a nozzle 61 at the front end thereof, a rotatable drive drum 7 and a drive motor 8.

On the supporting means 3, in addition to the guide channel 3*a* for the belt-like member there are also provided a first cylinder 5*a* in which the first piston 5 is disposed for shuttle movement, a second cylinder 6*a* in which the second piston 6 is put in for shuttle movement.

Inside the first piston 5 is hollow. The first piston 5 has a water-spouting nozzle 51 at the front end thereof and a water inlet 52 at the opposite end thereof. Similarly, the second piston 6 has a hollow inside. The piston 6 is provided with a water-spouting nozzle 61 at the front end thereof and a water inlet 62 at the opposite end thereof.

Within the housing 2, a pressurized water supply means (not shown) is incorporated. The pressurized water supply means is adapted to supply a given amount of water to a first water supply orifice 9 and a second water supply orifice 10.

When said first water supply orifice 9 comes in alignment with the water inlet 52 of the first piston 5, the orifice 9 and water inlet 52 communicate each other so as to be ready for water supply. In other positions, no water supply is made. Similarly, when said second water supply orifice 10 aligns with the water inlet 62 of the second piston 6, the orifice 10 and water inlet 62 communicate each other and become ready for water supply. In other positions, no water supply is conducted.

The belt-like member 4 is of metal type. For example, it may be an elongated leaf spring. This belt-like member is provided with a plurality of lateral slits 41 formed at regular intervals. The one end 42 of the belt-like member is secured to the first piston 5 by a screw 44 and the other end 43 of which is secured to the second piston 6 by a screw 45. Said slits 41 are designed to be engageable with teeth 71 on the peripheral surface of the drum 7.

By virtue of this arrangement, when the user depresses a switch of the drive motor 8 in the electric circuit (not shown), the drum 7 is rotatably driven by the motor 8 and consequently, the belt-like member 4 is slidably transported along the guide channel 3*a*. If one end portion 46 of the belt-like member 4 moves forward, the other end portion 45 moves backward and vice versa. That is, when the end portion 46 of the belt-like member 4 moves forward, the first piston 5 operatively associated with the belt-like member also moves forward, while the second piston 6 moves backward, and vice versa.

The first piston 5 is intended for the anus-washing and said second piston 6 is for the bidet-washing.

If the first piston 5 is moved to its advanced, operative position, the second piston 6 retracts to its rest position and automatically actuates a reed switch 63. Thereby, the driving motor 8 stops.

In this state, the aforesaid water inlet 52 of the first piston 5 communicates with the first water supply orifice 9 which is connected to the pressurized water supply means. Accordingly, the pressurized water from the pressurized water supply means flows into the space inside the first piston 5 through the water inlet 52. Thus water spouting nozzle for the anus-washing is activated.

Meanwhile, when the second piston 6 is moved to its advanced, operative position, the first piston 5 retracts to its rest position and automatically actuates a reed switch 53, whereby the motor 8 comes to stop. In this case, the water inlet 62 communicates with the second water supplying orifice 10 which is connected to the pressurized water supply means. Accordingly, the pressurized water flows into the space inside the second piston 6 through the water inlet 62. In this way, another water spouting nozzle for the bidet-washing becomes operative.

In order to move the first and second pistons in the opposite direction each other, it has been proposed to utilize a rack and pinion mechanism. This type of driving mechanism is disadvantageous in that some additional construction is needed to mount the pinion on the piston, and that it is quite difficult to determine the position of each nozzle so as to be exactly aligned with the corresponding washing objects. According to the first embodiment of the present invention, however, two pistons can be alternatively advanced or retracted by a drive assembly which is driven only by a single motor. This improved mechanism is remarkably distinguished in that the drive assembly for these pistons requires a very small number of parts, and in that the use of the belt-like member to move the pistons gives a high degree of freedom in designing the location of nozzles.

Embodiment 2

Hereinafter, a second embodiment according to the present invention will be explained.

Figures 3, 4:
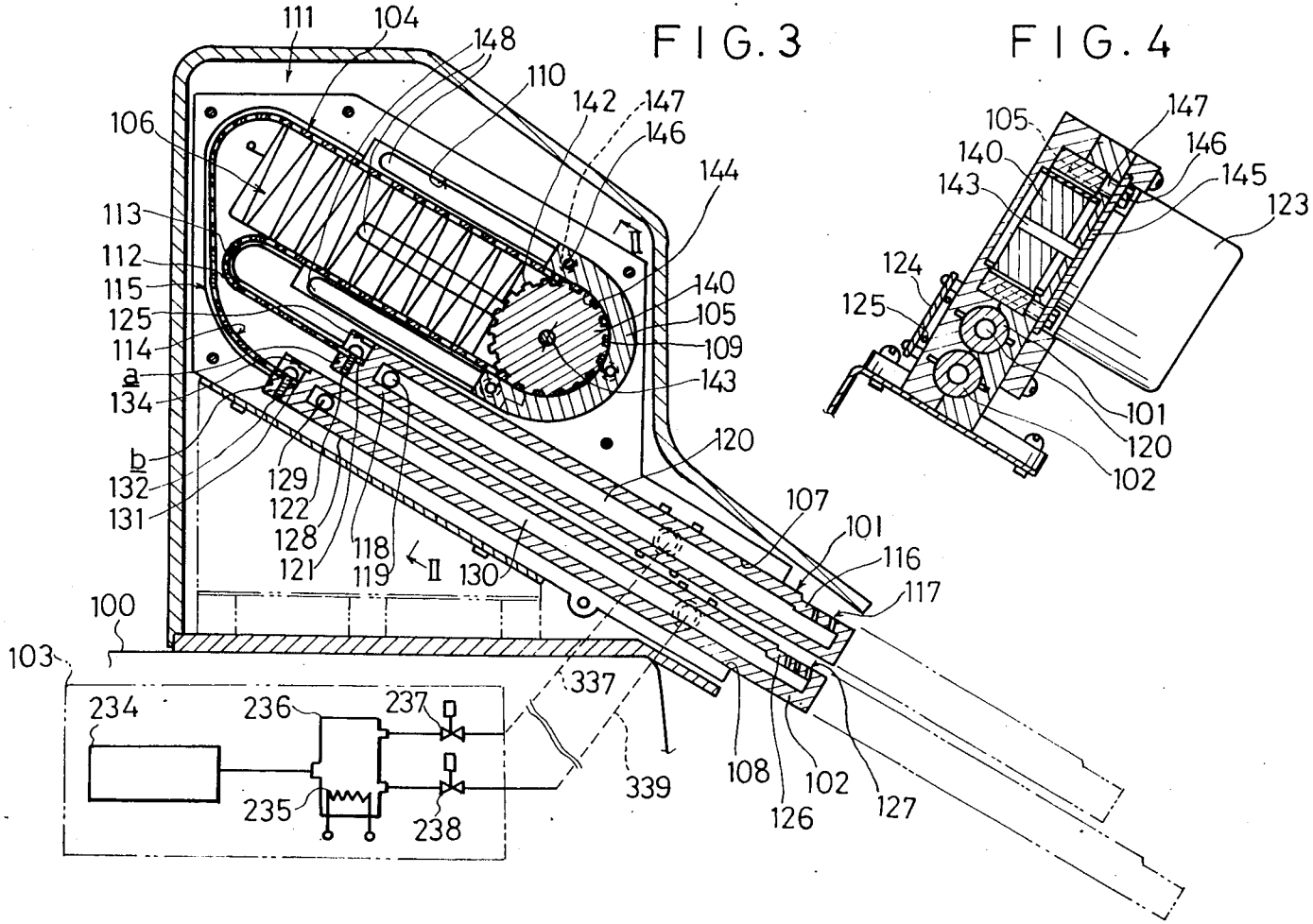
FIG. 3 is a sectional side elevation view illustrating the essential part with the associated pressurized water supply means according to a second embodiment of the present invention.
FIG. 4 is a sectional view taken along the line II—II of FIG. 3.
Figure 5:
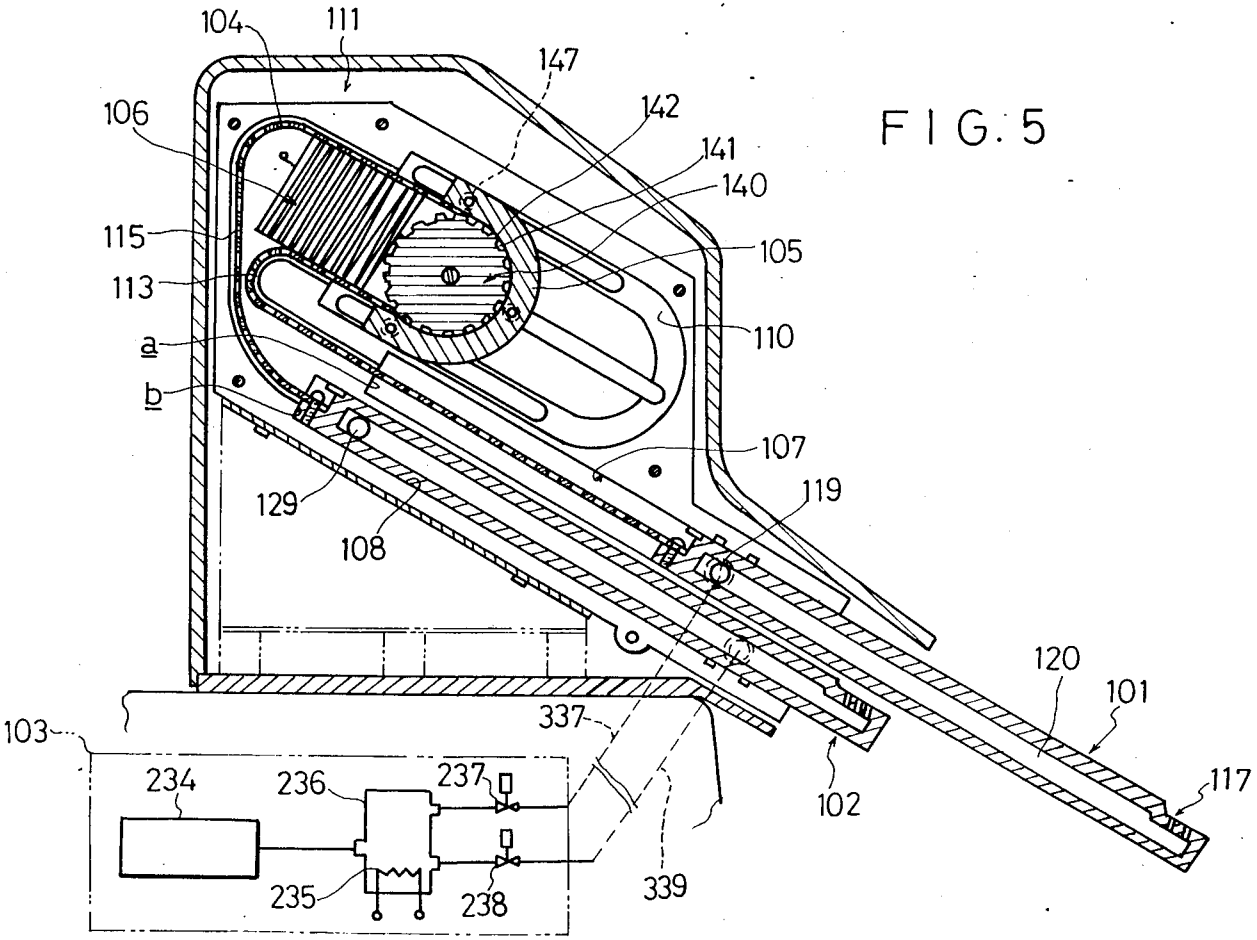
FIG. 5 is a view similar to FIG. 3 illustrating a middle position of the rotatable drive member.

A washing device according to this second embodiment is shown in FIGS. 3, 4, 5 and wherein the essential parts of this device are illustrated in sectional views. This second embodiment corresponds to the second aspect of the invention.

The washing device of this second embodiment comprises a toilet bowl 100, a first nozzle carrying piston 101 (hereinafter it will be called merely "a first piston 101"), a second nozzle carrying piston 102 (hereinafter it will be called merely "a second piston 102"), a pressurized water supply means 103, a belt-like member 104, a guide shoe 105 and a resilient member 106.

The gist of this second invention resides in the combined actions of said guide shoe 105 and resilient member 106.

The toilet bowl 100 is provided with a housing 111 in which the first piston 101, second piston 102, guide shoe 105, etc. are movably supported.

The housing 111 also includes a plurality of cylinders and guide channels as hereinafter described. That is, there are provided in said housing 111 a first cylinder 107 to slidably support said first piston 101, a second cylinder 108 to slidably support said second piston 102, a third cylinder 110 to slidably support said guide shoe 105 and a middle portion 109 of said belt-like member 104, a first guide channel 113 which supports one end portion 112 of said belt-like member 104 and connects said first cylinder 107 to said third cylinder 110, and a second guide channel 115 which supports the other end portion 114 of said belt-like member 104 and connects said second cylinder 108 to said third cylinder 110.

The inside of said first piston 101 slidable in said first cylinder 107 is hollow and forms a first water way 120 at one end 116 of which is provided a nozzle 117 for the anus-washing and at the other end 118 of which a first water inlet 119.

At the said other end 118, a front end 121 of said end portion 112 of said belt-like member 104 is fixedly secured by a screw 122. Also attached to the said other end 118 is a magnet 125 which is adapted to actuate a switch 124 in the electric circuit (not shown) which functions to stop a drive motor 123. (Please refer to FIGS. 3 and 4).

The inside of said second piston 102 slidable in said second cylinder 108 is hollow and forms a second waterway 130 at one end 126 of which is provided a nozzle 127 for the bidet-washing and at the other end 128 of which is provided a second water inlet 129.

At the said other end 128 of the second piston 108, a front end 131 of said end portion 114 of said belt-like member 104 is fixedly secured by a screw 132. Also attached to the said other end 128, is a magnet 134 which is adapted to actuate a switch in the electric circuit (not shown) which functions to stop energization of the drive motor 123.

The aforesaid pressurized water supply means 103 serves to selectively supply a predetermined amount of water to the first water inlet 119 and the second water inlet 129 for the anus- or bidet-washing.

The pressurized water supply means 103 comprises a hydraulic source 234, a water supply tank 236 having a heating means 235, a first water supply pipe 337 having a first valve 237 and connecting said tank 236 to the water inlet 119 of said first piston 101, and a second water supply pipe 339 having a second valve 238 and connecting said water supply tank 236 to the water inlet 129 of said second piston 102.

The middle portion 109 of said belt-like member 104 is supported and slidably guided by the structure including the third cylinder 110, the guide shoe 105 and a rotatable drive member 140.

Figure 7:
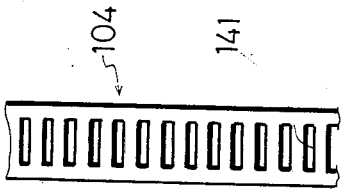
FIG. 7 is a partial plan view of a belt-like member.

Said belt-like member 104 is provided with a series of slits 141 perforated at regular intervals as shown in FIG. 7 so as to be engageable with the teeth 142 on the peripheral surface of the rotatable drive member 140.

As described above, said one end 112 of the belt-like member 104 is slidably guided and supported by the first guide channel 113, and is fixedly connected to the other end 118 of said first piston 101 with its front end 121 projected into the first cylinder 107.

Meanwhile, said the other end 114 of said belt-like member 104 is slidably guided and supported by the second guide channel 115 and is fixedly connected to the other end 128 of said second piston 102 with its front end 131 of said belt-like member projected into the second cylinder 108.

The guide shoe 105 has a semicircular-shaped inner wall 144 and is movably supported by the third cylinder 110 together with the rotatable drive member 140 and belt-like member 104 as hereinafter described. This guide shoe 105 is effective to limit the movements of the belt-like member 104 which is to be driven through the engagement of its middle portion 109 with the rotatable drive member 140, as aforementioned.

The rotatable drive member 140 is coupled to the rotational axis 143 of said drive motor 123 to be rotatably driven thereby, and is mounted on the mounting plate 145 with a little clearance from said semicircular inner wall 144 of the guide shoe 105.

Also secured to the mounting plate 145 are the drive motor 123 and the guide shoe 105 through the guide shafts 146.

On the guide shafts 146, spacer elements 147 are interposed between the mounting plate 145 and guide shoe 105. These spacer elements 147 in turn are disposed slidably in the grooves 148. Thereby, said guide shafts 146 can slide in the grooves 148, and thus, a drive assembly comprising said guide shoe 105, rotatable drive member 140 and belt-like member 104 are movably supported in the third cylinder 110.

Figure 9:
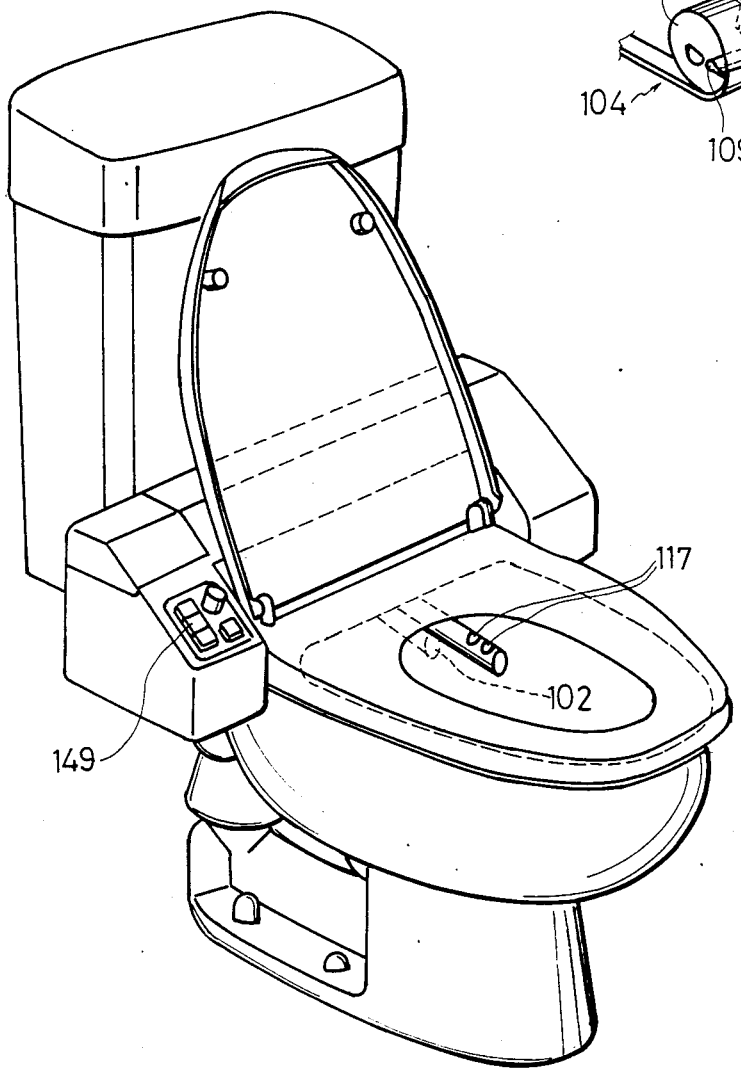
FIG. 9 is a perspective view illustrating the entire configuration of the washing device according to the present invention.

It is to be appreciated that said guide shafts may be used with bolts and that the electric circuit (not shown) for said drive motor 123 may include a group of switches 149 as shown in FIG. 9.

The aforesaid resilient member 106 is disposed in the third cylinder 110 and serves to urge said guide shoe 105 in the axial direction of said third cylinder 110 in such a manner that movements of said guide shoe 105 become larger within the range of the total length of said third cylinder 110. It is to be noted that the resilient member 106 may be a leaf spring.

Next, the operation of this washing device will be explained.

The state of this washing device when it is not used is as shown in FIG. 3.

In this state, the guide shoe 105 is maintained at its one extreme position where an amount of movement is at the maximum. The first and second pistons 101 and 102 are at rest positions, being stored in the first guide channel 113 and in the second guide channel 115, respectively. At this time, neither the first water inlet 119 of the first pistion 101 nor the second water inlet 129 of the second piston 102 is in alignment with their corresponding first waterway 120 and second waterway 130 of the pressurized water supply means 103.

If the user depresses a switch for the anus-washing or the bidet-washing, then, the drive motor 123 starts to rotate and the belt-like member 104 commences sliding axially and simultaneously moves either clockwise or counterclockwise. For example, when the switch for the anus-washing is selected and depressed, first said rotatably drive member 140 is rotated clockwise.

At the same time, the middle portion 109 of the belt-like member 104 is drawn clockwise. The second piston 102 abuts the extremity b of the second cylinder 108 and remains stationery. Accordingly, the end portion 114 of the belt-like member 104 does not move at all, while the other end 112 and the middle portion 109 of the member 104 in the first guide channel 113 are forcibly fed out forward.

By this displacement of the belt-like member 104, the first piston 101 is moved up to its advanced, operative position. Upon arrival of this first piston 101 at the given position, the first water inlet 119 comes to align the first water supply pipe 337 and communicates therewith. At the same time, the magnet 125 is actuated to open the switch 124 for the drive motor 123.

With stoppage of the driving motor 123, the rotatable drive member 140 also stops rotating and the first piston 101 is stopped at its exact operative position as shown in FIG. 5. Simultaneously, the first valve 237 opens and a given amount of the pressurized water enters into the first waterway 120 through the water inlet 119. Then, the pressurized water entered is spouted from the nozzle 117 for the anus-washing.

Under the aforesaid condition, if the rotatable drive member 140 is rotated counter-clockwise, the rotatable drive member 140 is slidably moved until it abuts the extreme position and the third cylinder 110 while being rotated counterclockwise, together with the guide shoe 105 under the action of the resilient member 106. By this combined action of the rotatable drive member 140 and the guide shoe 105, the end portion 112 of the belt-like member 104 is pulled nearer. In this way, the first piston 101 has been returned to its original retracted position as shown in FIG. 3 while maintaining the second piston 102 stationary at its retracted position.

In the meantime, if the user wants to use the bidet-washing under the condition as shown in FIG. 3, he is required to depress to switch for the bidet-washing. The rotatable drive member 140 rotates counterclockwise in this case. Thereby, the middle portion 109 of the belt-like member 104 is drawn counterclockwise. The rear end of the first piston 101 abuts strongly against the extremity a of the first cylinder 107 and the first piston 101 remains stationery. Accordingly, the end portion 112 of the belt-like member 104 does not move at all, while the other end 114 and the middle portion 109 of the member 104 in the second guide channel 115 are forcibly fed out forward.

Figure 6:
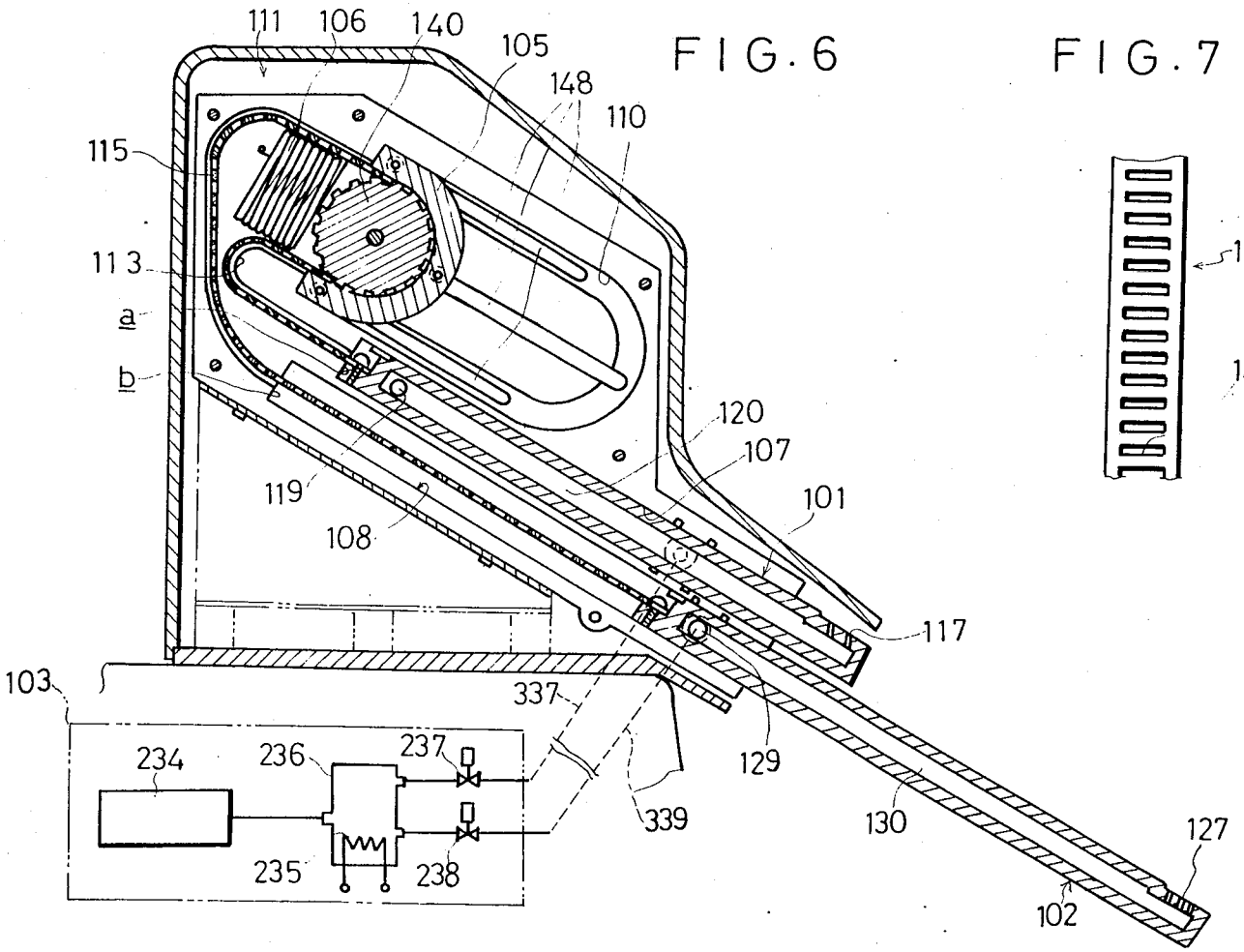
FIG. 6 is a view similar to FIG. 3 illustrating one extreme position of the rotatable drive member.

By this displacement of the belt-like member 104, the second piston 102 is moved to its advanced, operative position. Upon arrival of this piston 102 at the given position as shown in FIG. 6, the second water inlet 129 comes to align the second water supply pipe 339, and communicates each other. At the same time, the magnet 134 is actuated to open the switch (not shown) for the drive motor 123. Upon stoppage of the motor 123, the rotatable drive member 140 also stops rotating and thus, the second piston 102 is stopped at the exact operative position. Simultaneously, the second valve 238 is automatically opened and pressurized water is applied to the second waterway 130. Then, the pressurized water entered is jet from the nozzle 127 for the bidet-washing.

Under the aforesaid condition, if the user wants to return the second piston 102 to its initial inoperative position as shown in FIG. 3, the rotatable drive member 140 is rotated clockwise. The rotatable drive member 140 while being rotated, moves to its extreme end position in the third cylinder 110 under the action of the resilient member 106, together with the guide shoe 105. By the displacement of these members, the end portion 114 of the belt-like member 104 is pulled nearer.

In this way, the second piston 102 has been returned to its initial inoperative position as shown in FIG. 3 while keeping the first piston 101 stationery at its retracted position.

Figure 8:
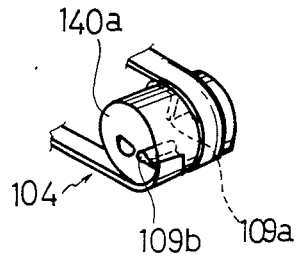
FIG. 8 is a partial perspective view of the modified rotatable drive member and the belt-like member associated therewith.

Hereinafter, the modified structure of the rotatable drive member and the belt-like member will be explained referring to FIG. 8. In this modification, except the following points, the essential parts of the operation mechanism is substantially the same as aforedescribed ones. The middle portion 109 of the belt-like member 104 which engages around the periphery of the rotatable drive member 140*a* are divided into two separate end portions 109*a* and 109*b*. These end portions 109*a* and 109*b* are fixedly secured to the rotatable drive member 140*a* in such a manner that when one of said end portions 109*a* and 109*b* is taken up, the one is fed out.

According to this modified mechanism, since two end portions 109*a* and 109*b* are fixed to the rotatable drive member 140*a*, there is no fear that any slippage between them will occur. Far from that, this mechanism gives more reliable belt-driving system, resulting in more reliable shuttle movement of the first and second pistons.

What is claimed as new and desired to be secured by Letters Patent of the United States is:

1. A washing device for parts of human body, comprising:

a housing to be mounted on a toilet bowl;

a supporting means disposed in said housing;

a first nozzle carrying means movably supported by said supporting means;

a second nozzle carrying means movably supported by said supporting means;

a drive means for selectively moving one of said first and second nozzle carrying means to or from an operative position where said nozzle carrying means extends into said bowl, said drive means including at least one drive motor; and a pressurized water supply means for supplying pressurized water to either one of said first and second nozzle carrying means only after one of said nozzle carrying means is exactly located in the operative position; wherein:

said drive means comprises a rotatable member to be reversibly driven by said drive motor and a belt-like member one end of which is fixedly secured to said first nozzle carrying means and the other end of which is fixedly secured to said second nozzle carrying means, and said belt-like member having its middle portion normally engaging the periphery of said rotatable member.

2. A washing device for parts of human body as claimed in claim 1, wherein:

said rotatable member is a drum to be frictionally engageable with said middle portion of the belt-like member, and said belt-like member is made of a hard but pliable metal strip.

3. A washing device for parts of human body as claimed in claim 1, wherein:

said rotatable member is a toothed-wheel, and said belt-like member is provided with a plurality of slits or holes formed at regular intervals so as to be engageable with the teeth of said rotatable member.

4. A washing device for parts of human body, comprising:

a housing to be mounted on a toilet bowl;

a supporting means disposed in said housing;

a first nozzle carrying means movably supported by said supporting means;

a second nozzle carrying means movably supported by said supporting means;

a drive means for selectively moving one of said first and second nozzle carrying means to or from an operative position where said nozzle carrying means extends into said bowl, said drive means comprises a drive motor, a rotatable drive member to be reversibly driven by said motor, a belt-like member one end of which is fixedly secured to said first nozzle carrying means and the other end of which is fixedly secured to said second nozzle carrying means said belt-like member having its middle portion normally engaging the periphery of said rotatable member, a guide shoe adapted to be slidable along the predetermined path as a unit together with said rotatable member and the middle portion of said belt-like member, and a resilient member normally urging said drive means to the extreme position where movements of said belt-like member becomes maximum, said rotatable member is slidable while rotating, a pressurized water supply means for supplying pressurized water to either one of said first and second nozzle carrying means only when one of said means is in the operative position.

5. A washing device for parts of human body as claimed in claim 4, which comprises:

a sensing means for detecting when said first or second nozzle carrying means has arrived at its operative position; and an electric circuit includes at least a switch to be responsive to output signal from said sensing means for stopping said drive motor.

6. A washing device for parts of human body as claimed in claim 4, wherein said supporting means comprises a first, second and third cylinders mounted thereon; said first cylinder is adapted to slidably guide a first hollow piston with a nozzle at the front thereof, said second cylinder is adapted to slidably guide a second hollow piston and said third cylinder is adapted to slidably guide said guide shoe, rotatable member and the middle portion of said belt-like member; and curved grooves to define the path for said belt-like member.

7. A washing device for parts of human body as claimed in claim 6, wherein said first and second hollow pistons further comprise a water inlet respectively, to receive the pressurized water from said pressurized water supply means.

8. A washing device for parts of human body as claimed in claim 4, wherein said rotatable drive member is a drum to be frictionally engageable with said middle portion of the belt-like member, and said belt-like member is made of a hard but pliable metal strip.

9. A washing device for parts of human body as claimed in claim 4, wherein said rotatable member is a toothed-wheel, and said belt-like member is provided with a plurality of slits or holes formed at regular intervals so as to be engageable with the teeth of said rotatable member.

10. A washing device for parts of human body as claimed in claim 4, wherein said pressurized water supply means comprises a hydraulic control means, a water tank with heating means, a first water supply passage having a first valve and connecting said water tank to the water inlet of said first nozzle carrying means, and a second water supply passage having a second valve and connecting said water tank to the water inlet of said first nozzle carrying means.

11. A washing device for parts of human body as claimed in claim 4, wherein said middle portion of said belt-like member is divided in two separate parts and each end of these separates parts of said rotatable member is fixedly attached to the core of said rotatable member.

* * * * *